US006241132B1

(12) United States Patent
Morrison

(10) Patent No.: US 6,241,132 B1
(45) Date of Patent: Jun. 5, 2001

(54) FLUID DISPENSING APPARATUS WITH FITMENT SPOUT AND VALVE

(75) Inventor: Adam P. Morrison, Rockford, IL (US)

(73) Assignee: The Testor Corporation, Rockford, IL (US)

( * ) Notice: Subject to any disclaimer, the term of this patent is extended or adjusted under 35 U.S.C. 154(b) by 0 days.

(21) Appl. No.: 09/307,626

(22) Filed: May 7, 1999

Related U.S. Application Data

(60) Provisional application No. 60/089,456, filed on Jun. 16, 1998, and provisional application No. 60/085,311, filed on May 13, 1998.

(51) Int. Cl.[7] ..... B65D 47/10

(52) U.S. Cl. ..... 222/541.6; 222/541.9; 222/562

(58) Field of Search ..... 222/541.6, 541.9, 222/490, 562, 107

(56) References Cited

U.S. PATENT DOCUMENTS

| | | | | |
|---|---|---|---|---|
| 2,802,608 | * | 8/1957 | Gassaway | 222/490 |
| 5,577,643 | * | 11/1996 | Stolz | 222/541.9 |
| 5,586,672 | * | 12/1996 | Schneider et al. | 222/541.6 |
| 5,622,283 | | 4/1997 | Morrison . | |
| 5,699,936 | * | 12/1997 | Sakamoto | 222/107 |
| 5,845,812 | | 12/1998 | Morrison . | |

* cited by examiner

*Primary Examiner*—Philippe Derakshani
(74) *Attorney, Agent, or Firm*—Fay, Sharpe, Fagan, Minnich & McKee, LLP

(57) ABSTRACT

A fluid dispensing system includes a base for attachment to an associated pouch and a neck extending outwardly therefrom away from the pouch. The neck and base include a bore formed therethrough in fluid communication with the pouch interior. The neck comprises first and second portions, and the bore is closed at its outermost end by the second neck portion. The second portion is selectively removable from the first portion to open the bore and provide access to the contents of the pouch. The second portion can be at least partially separated from the first portion by selective application of bending or torsional stress or the like thereto. The application of stress results in partial or complete disconnection of the second portion from the first portion along a weakened material zone. The weakened material zone is defined by an area of reduced material thickness or by scoring or the like. A normally closed valve is optionally employed as a part of the fitment and is adapted for preventing undesired spillage of liquid from the associated pouch. The valve is constructed from a resilient material such as rubber or other flexible polymer, and the application of manual pressure to one or more regions of the valve opens a fluid passage formed therethrough. The neck is optionally enclosed by a removable sanitary overwrap to prevent undesired contamination of the fitment neck during shipping and storage.

22 Claims, 7 Drawing Sheets

FLUID DISPENSING APPARATUS WITH FITMENT SPOUT AND VALVE

This Appln claims the benefit of Provisional Application No. 60/085,311 filed May 13, 1998 and Provisional Application No. 60/089,456 filed Jun. 16, 1998.

BACKGROUND OF THE INVENTION

The present invention pertains to the art of fluid dispensing apparatus, and more particularly to a collapsible pouch or bag including a dispensing fitment for effectively and conveniently dispensing fluid from the pouch. The fluid dispensing fitments involved are particularly suited for dispensing fluid directly for human consumption if desired, i.e., in the manner of a drinking "straw." Although the invention will be described with particular reference to the preferred embodiments, it will be appreciated that the invention has broader application and may be advantageously employed in other environments and applications for dispensing any of a wide variety of fluids both for human consumption and otherwise.

It is generally known to use a flexible or collapsible bag or pouch to retain and selectively dispense fluids and other viscous materials. However, prior pouch arrangements have included large, complex, and expensive outlet fittings and/or valve structures not suitable for conveniently dispensing fluid for direct human consumption. Other prior designs have required use of a separate drinking straw that must be pushed or inserted into the pouch, an operation often resulting in a stream of fluid being accidentally forced under pressure from the drinking straw onto those nearby. Furthermore, such prior systems have not included easily openable outlet fittings or fitments particularly adapted to facilitate human consumption directly from the associated fluid retaining pouch.

Accordingly, it has been deemed desirable to develop fluid dispensing apparatus with fitment spouts for use in association with fluid containing pouches that are convenient and easy to open and use, sanitary, inexpensive to manufacture, and which prevent undesired spillage of liquid from the associated pouch.

SUMMARY OF THE INVENTION

In accordance with the present invention, a fluid dispensing system includes a fluid container defining an internal cavity adapted for retaining fluid, and a fitment connected to the container. The fitment is adapted for dispensing fluid from the container and includes a base adapted for securement to the container and a neck first portion extending outwardly from the base away from the container. The neck first portion and base include a bore therein in fluid communication with the internal cavity of the container. A neck second portion is removably connected to the neck first portion by a weakened material zone in fluid-blocking relation with the bore. The neck second portion is adapted for at least partial separation from the neck first portion upon application of stress to the neck second portion to rupture the weakened material zone and open the bore.

In accordance with another aspect of the present invention, a fitment spout adapted for dispensing fluid from an associated container includes a base adapted for being fixedly secured to the container, a neck first portion, and a neck second portion. The first portion of the neck projects outwardly from the base away from the container. The neck and base together defining a bore in fluid communication with an interior portion of the container. The second portion of the neck is connected to the first portion and blocks the bore in a fluid-tight manner. The neck second portion is interconnected to the first portion by way of a frangible zone of material whereby the second portion is adapted for selective separation from the first portion upon application of stress thereto for at least partially rupturing the frangible zone.

In accordance with another aspect of the invention, a fluid dispenser includes a container adapted to retain fluid in an interior portion and an elongated fitment member for dispensing fluid from the container. The fitment member defines a bore extending from a first end to a second end, and is connected to the fluid container so that the bore is in fluid communication with the interior portion of the container at the first end of the fitment member and projects outwardly from the container. A flexible sanitary overwrap at least partially covers the second end of the elongated fitment member. The sanitary overwrap includes an inner surface sealingly and releasably engaged with the second end of the fitment member to block fluid flow out of the container interior portion through the bore.

In accordance with yet another aspect of the present invention, a fitment for dispensing fluid includes a first portion adapted for being fixedly secured to an associated container and a second portion connected to and projecting outwardly from the first portion. The first and second portions define a bore in fluid communication with an interior portion of an associated container. A normally closed valve is connected to the second portion and at least substantially blocks fluid flow out of the associated container through the bore. The valve is selectively openable to allow fluid flow through the bore.

One advantage of the present invention resides in the provision of a new and improved fluid dispensing apparatus with an associated fitment spout.

Another advantage of the invention is found in the provision of a fluid dispensing apparatus with an easily and conveniently opened fitment.

A further advantage of the invention is the provision of a fluid dispensing apparatus with a fitment particularly adapted for dispensing fluid for direct human consumption in a sanitary and convenient manner.

Another advantage of the invention resides in the ease of manufacturing an effective fluid dispensing apparatus at relatively low cost.

A still further advantage of the invention is found in the provision of a spill-proof fluid dispensing apparatus with a selectively openable and closable valve for convenient dispensing of fluid.

Still other benefits and advantages of the present invention will become apparent to those of ordinary skill in the art upon reading and understanding the present specification.

BRIEF DESCRIPTION OF THE DRAWINGS

The invention may take physical form in certain parts and arrangements of parts, preferred embodiments of which are described herein and illustrated in the accompanying drawings which form a part hereof, wherein.

DETAILED DESCRIPTION OF PREFERRED EMBODIMENTS

Figure 1A:
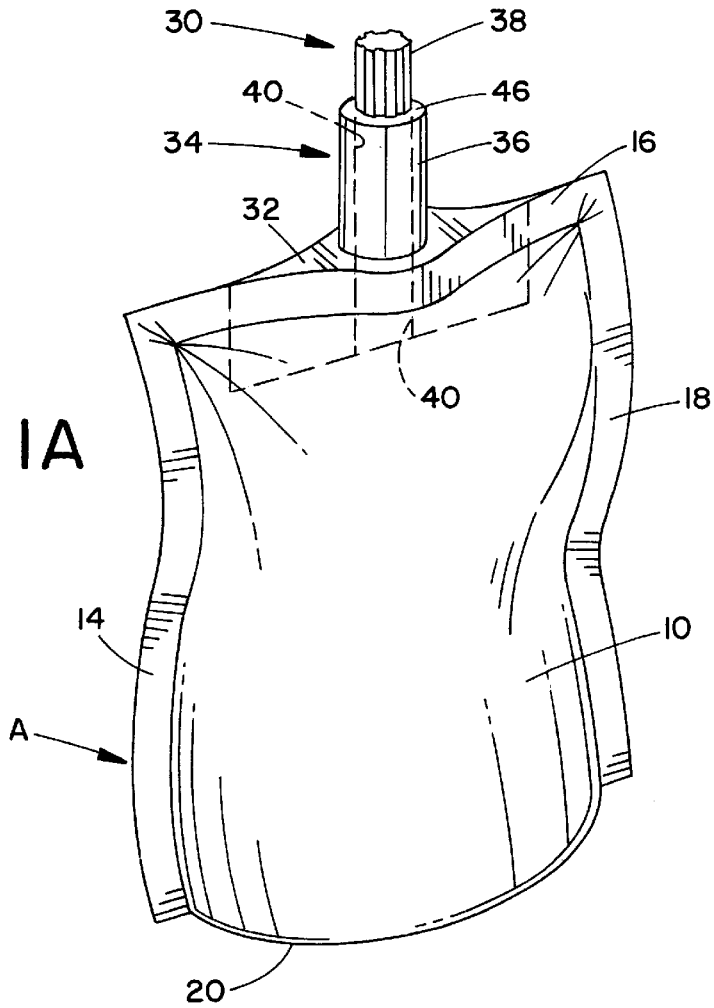
FIG. 1A is a front perspective view of a fluid dispensing apparatus with a fitment spout formed in accordance with the present invention.
Figure 1B:
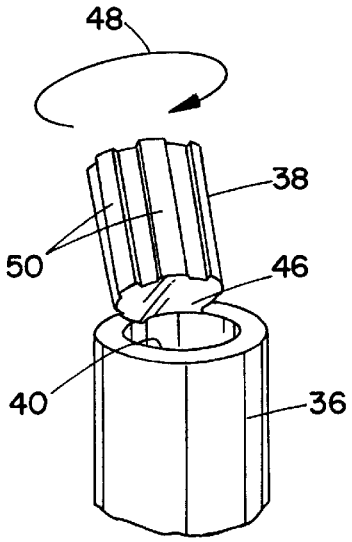
FIG. 1B is an enlarged partial perspective view of the fitment spout of FIG. 1A illustrating selective opening of the spout for dispensing fluids.
Figure 1C:
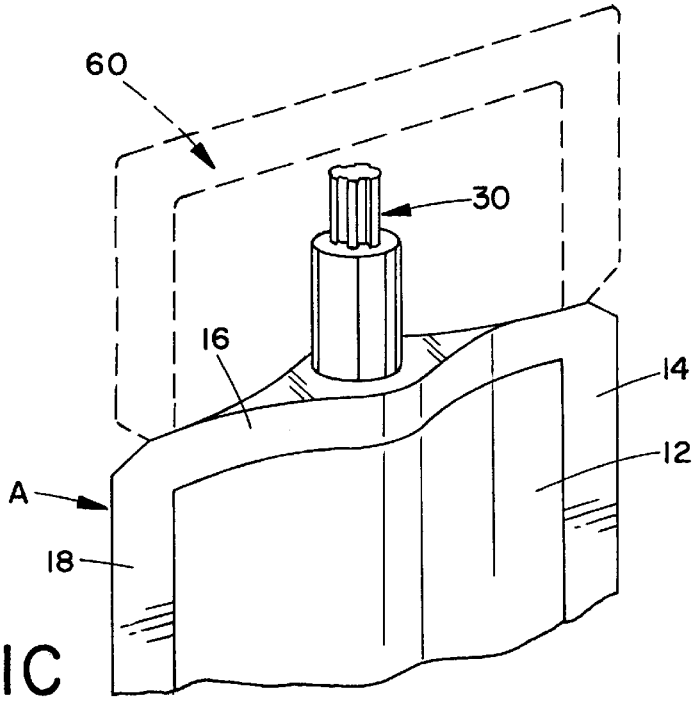
FIG. 1C is a rear partial perspective view of the apparatus of FIG. 1A showing an optional fitment spout sanitary overwrap formed in accordance with the present invention in broken lines.

Referring now to the drawings wherein the showings are for purposes of illustrating preferred embodiments of the invention only and not for purposes of limiting same, FIGS. 1A and 1C show a fluid dispensing apparatus with an associated fitment spout formed in accordance with the present invention including a collapsible pouch A adapted for retaining fluid. Pouch A is fabricated from any of a wide variety of suitable thin, flexible, and fluid impervious materials such as polyethylene or other suitable polymers, papers, cardboards, films, and metallized or coated versions of same.

Pouch A is formed, for example, from a single piece of suitable material folded upon and sealed to itself at desired locations. As shown herein, pouch A comprises a one-piece construction defined by first and second opposite lateral side walls 10,12 sealed to each other along peripheral regions by heat fusion, adhesives, or the like to form peripheral seams 14,16,18. Lower region 20 of the pouch is preferably formed by one or more folds. Accordingly, pouch A includes an interior cavity adapted to retain some predetermined volume of fluid such as a beverage or the like. The thin, flexible side walls 10,12 expand outwardly away from each other to accommodate fluid, and contract inwardly toward each other to dispense fluid under pressure (or upon fluid being dispensed by suction or pouring) from the interior cavity of pouch A.

A fluid outlet fitting or "fitment" 30 is connected or secured to the pouch A. Fitment 30 preferably comprises a one-piece construction of plastic such as polyester or the like, and comprises a base portion 32 and a neck portion 34 projecting outwardly therefrom. As shown, the base portion 32 is secured to the pouch by being positioned and sealed into one of the peripheral seams 14,16,18, e.g., seam 16 as shown herein. The neck 34 is comprised of first and second portions 36,38, which are preferably cylindrical, and a bore 40 is advantageously formed through the base 32 and neck first portion 36 so that the bore is placed in fluid communication with the pouch interior. Until removed, the neck second portion 38 blocks or caps the bore 40 to prevent the escape of fluid from the pouch.

With reference now also to FIG. 1B, neck first and second portions 36,38 are interconnected by a frangible or weakened material zone 46 that allows for selective partial or complete disconnection of the second portion 38 as desired to open the outermost end of the bore 40 for dispensing fluid from the pouch A. In particular, weakened zone 46 is preferably formed or provided by an area of reduced material thickness relative to adjacent regions, but may be alternatively or additionally provided by scoring, compression scoring, partial perforations, or other fluid-tight material weakening means or methods. Alternatively, neck second portion 38 may be affixed to the first portion in a fluid-tight manner by an adhesive, heat fusion, or by interference fit or other suitable mechanical interaction. Weakened zone 46 facilitates removal of second portion 38 upon application of manual bending and/or torsional stress to the second portion 38 as indicated by the arrow 48. Second portion 38 preferably includes flutes or ribs 50 or the like formed in its outer surface to facilitate the grasping thereof for ease of removal. When the second portion 38 is at least partially separated, and preferably completely separated, from the first portion 36, the outermost end of bore 40 is opened or exposed so that fluid poured or retained in the pouch A can be readily dispensed through the bore 40. Of course, in the case of beverages, the fluid may be consumed directly from the neck first portion in the manner of a drinking "straw" or spout.

FIG. 1C also illustrates an optional sanitary overwrap 60 which at least partially covers and prevents contamination of the fitment neck 34. Overwrap 60 is preferably constructed from the same material as the pouch A, but any other suitable wrap, film, or sheet material may be advantageously used without departing from the overall scope and intent of the present invention. Overwrap 60 is connected to the pouch A and/or the fitment 30 by heat fusion, adhesive, or other suitable means.

Figure 2A:
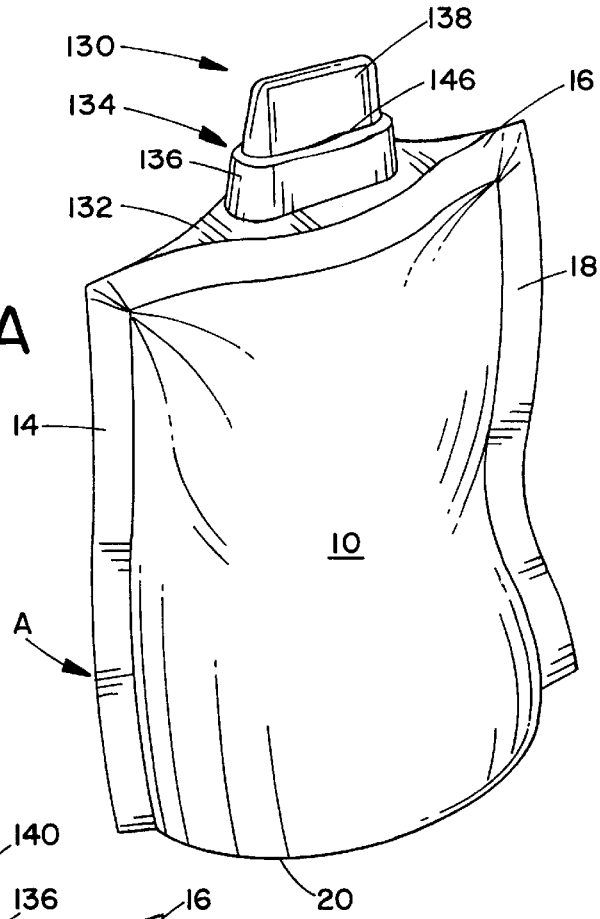
FIG. 2A is a perspective view of an alternative fluid dispensing apparatus with a fitment spout formed in accordance with the present invention.
Figure 2B:
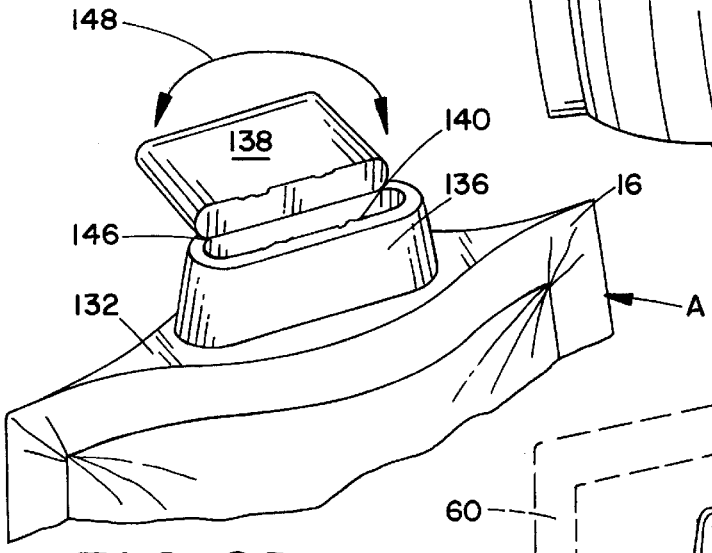
FIG. 2B is an enlarged partial perspective view of the fitment spout of FIG. 2A illustrating selective opening of the fitment to dispense fluid therefrom.
Figure 2C:
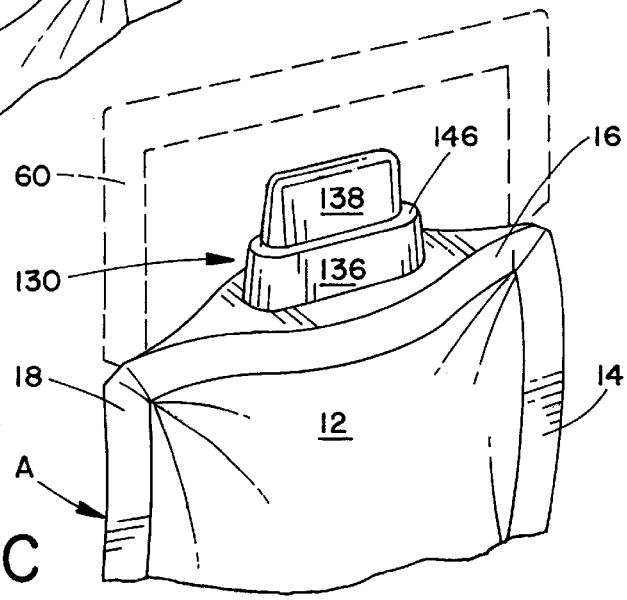
FIG. 2C is a partial rear perspective view of the apparatus of FIG. 2A showing a fitment spout sanitary overwrap in broken lines.

FIGS. 2A–2C illustrate a fluid dispensing apparatus formed in accordance with an alternative embodiment of the present invention. The apparatus shown in FIGS. 2A–2C is similar in all respects to that shown in FIGS. 1A–1C, but includes an alternative fitment 130. Accordingly, corresponding components of fitment 130 relative to fitment 30 are identified by reference numerals "100" greater than the reference numerals used in FIGS. 1A–1C for ease of appreciating the similarities and differences between the two embodiments.

Neck 134 of this alternative fitment is non-cylindrical and includes flattened or oval first and second portions 136,138 interconnected by a frangible, weakened material zone 146. As best illustrated in FIG. 2B, application of manual bending stresses indicated by arrow 148 results in at least partial separation of the second portion from the first portion 136 along the weakened zone 146 to allow fluid communication with the pouch interior through the bore 140 for dispensing fluid from the pouch A. A sanitary overwrap 60 (FIG. 2C) is optionally employed to protect the fitment from contamination.

Figure 3A:
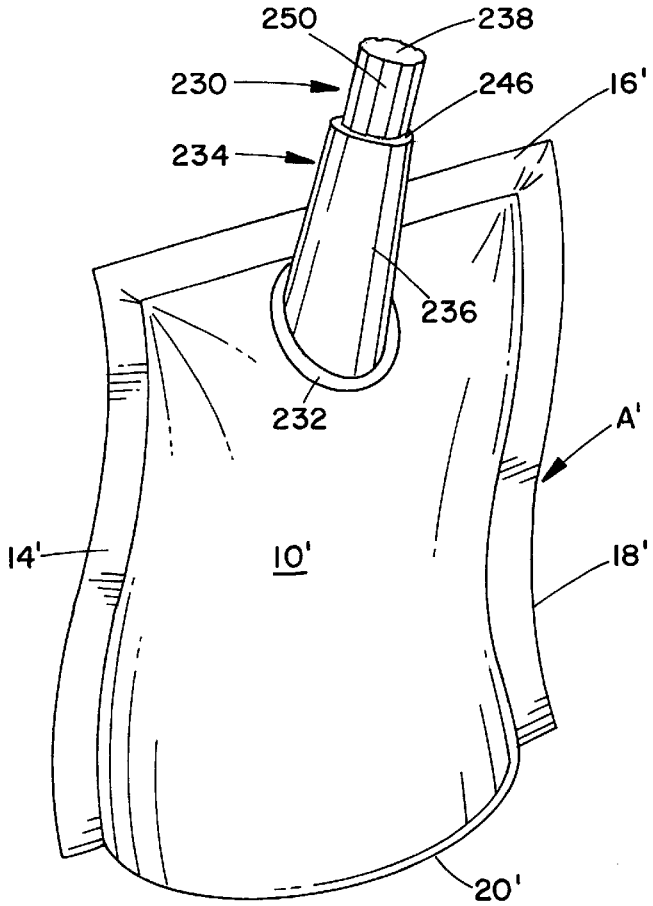
FIGS. 3A and 3B show perspective and side elevational views, respectively, of a fluid dispensing apparatus with a fitment spout formed in accordance with a third embodiment of the present invention.
Figure 3B:
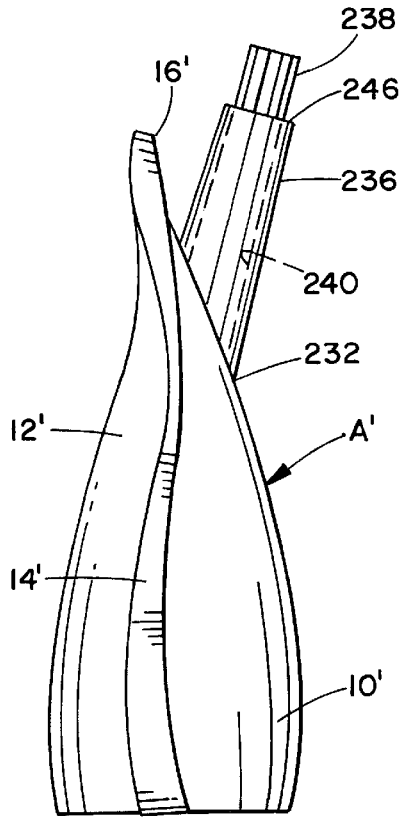

FIGS. 3A and 3B show another alternative fluid dispensing apparatus formed in accordance with the present invention including an alternative pouch A' and associated fitment 230. Except as noted and as is apparent from the drawings, pouch A' and fitment 230 are similar in all respects to the pouch A and the fitments 30,130. Like parts of the pouch A' relative to the pouch A are identified with like reference numerals including a primed (') suffix while like parts of the fitment 230 relative to the fitment 30 are identified with reference numerals that are "200" greater than those used in FIGS. 1A–1C.

Pouch A' differs from pouch A in that the seam 16' is uninterrupted by the fitment 230. Rather, the base 232 of the fitment 230 is connected or secured directly to the side wall 10' so that the fitment bore 240 is in fluid communication with the pouch interior. The base 232 is preferably provided by a radially enlarged flange projecting outwardly from the periphery of the first neck portion 236 to provide a convenient location for connection to the wall 10' of the pouch A'.

Figure 3C:
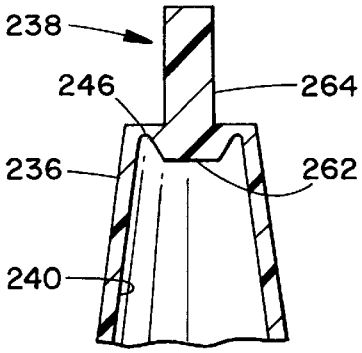
FIGS. 3C and 3D are partial cross-sectional views of the fitment spout shown in FIGS. 3A and 3B, with FIG. 3D showing selective opening of the fitment spout to dispense fluid from an associated fluid pouch or other container.
Figure 3D:
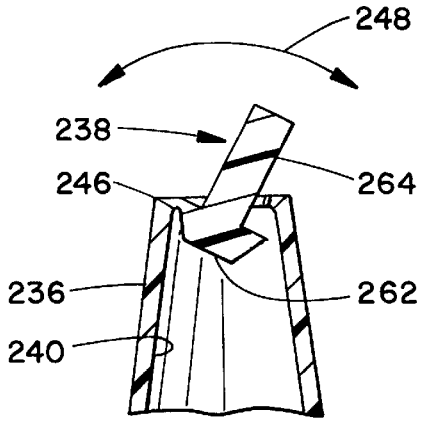

With reference also to FIGS. 3C and 3D, neck first portion 236 is generally frusto-conical or eccentric frusto-conical in configuration, and neck second portion 238 includes a radially enlarged lower section 262 with a post or shaft projecting outwardly therefrom. The enlarged lower section 262 is positioned in the bore 240 and is connected to the first neck portion by a frangible, weakened zone of material 246. Application of bending stresses to the projecting post 264 as indicated by the arrow 248 results in partial or complete separation of radially enlarged portion 262 from the neck first portion 236 for allowing fluid to be dispensed from the pouch A' through the bore 240.

Figure 4A:
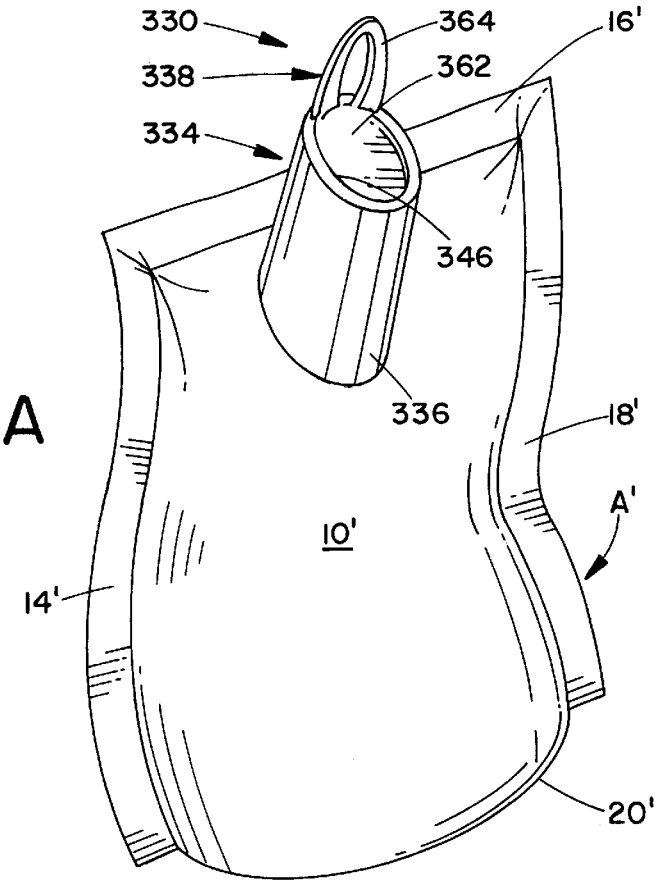
FIG. 4A is a perspective view showing a fourth fluid dispensing apparatus with a fitment spout formed in accordance with the present invention.
Figure 4B:
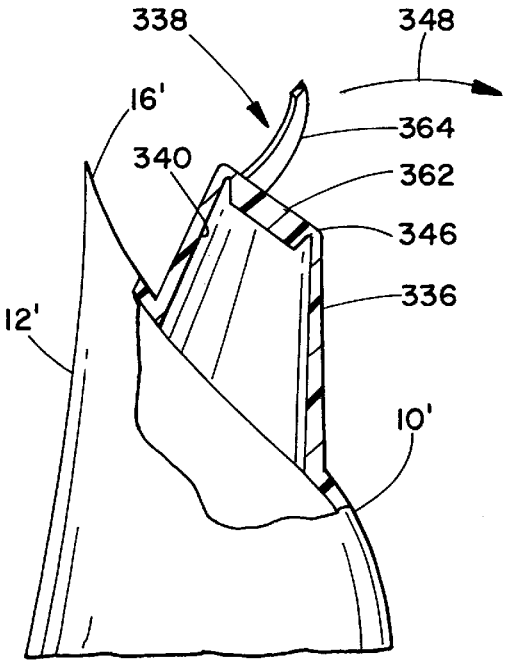
FIGS. 4B and 4C are partial side cross-sectional views of the fluid dispensing apparatus of FIG. 4A and the selective opening of the fitment spout to dispense fluid.
Figure 4C:
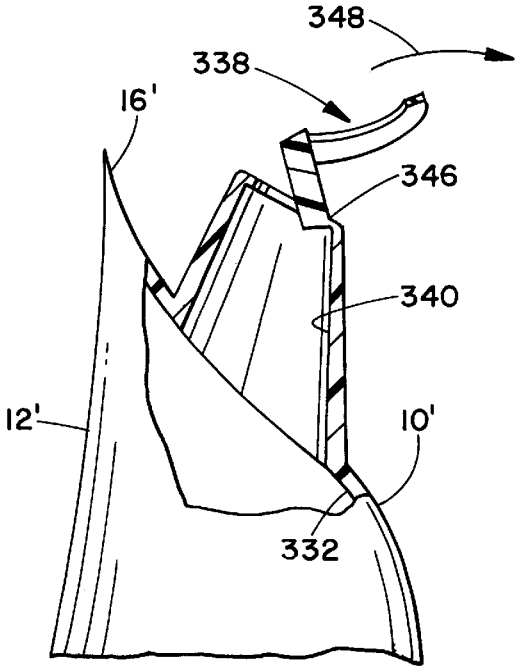

FIGS. 4A–4C illustrate still another alternative fluid dispensing apparatus formed in accordance with the present invention utilizing a fitment 330 in conjunction with a pouch A' as previously described. Fitment 330 corresponds to fitments 30,130,230 except as described and shown, and like components of fitment 330 are identified using reference numerals "300" greater than those used in FIGS. 1A–1C.

The flange-like base 332 of fitment 330 is connected to pouch side wall 10' so that the bore 340 is in fluid communication with the pouch interior. The neck first portion 336 is preferably frusto-conical or eccentric frusto-conical in configuration. The second portion 338 of neck 334 includes a radially enlarged base 362 which includes a pull-tab or pull-ring 364 extending outwardly therefrom and particularly adapted for grasping by hand. The base 362 is positioned in the bore 340 and is connected to the surrounding neck first portion via weakened zone of material 346. Removal of the neck second portion 338 from the first portion 336 is effected by upward and outward pulling on the tab or ring 364 away from the pouch A' in the manner indicated by the arrow 348. Such action causes the radially enlarged portion 362 to be pulled away from the neck first portion 336 along the weakened zone 346 for opening the bore 340 and facilitating dispensing of fluid from the pouch A'. The entire fitment 330, including the pull-ring 364, is preferably a one-piece construction of molded plastic material.

Figure 5A:
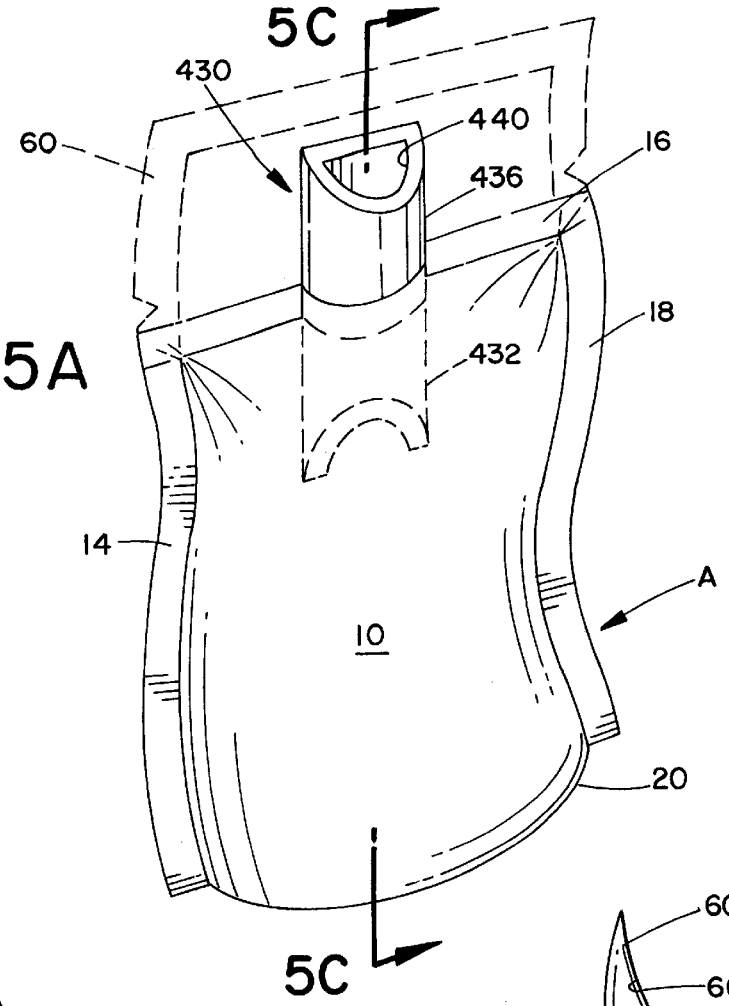
FIGS. 5A and 5B are perspective and side elevational views, respectively, of a fluid dispensing apparatus with a fitment spout formed in accordance with a fifth embodiment of the present invention.
Figure 5B:
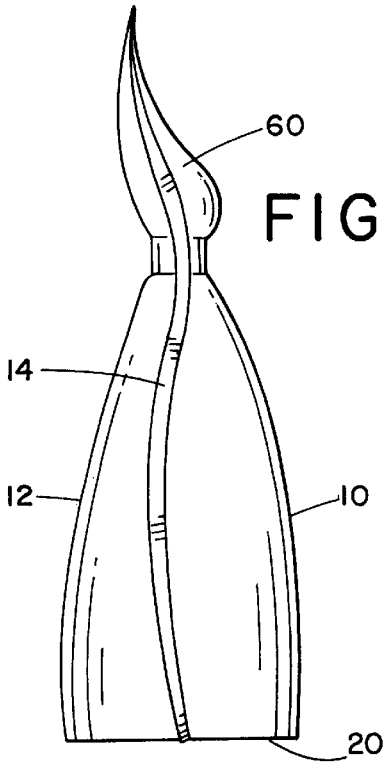
Figure 5C:
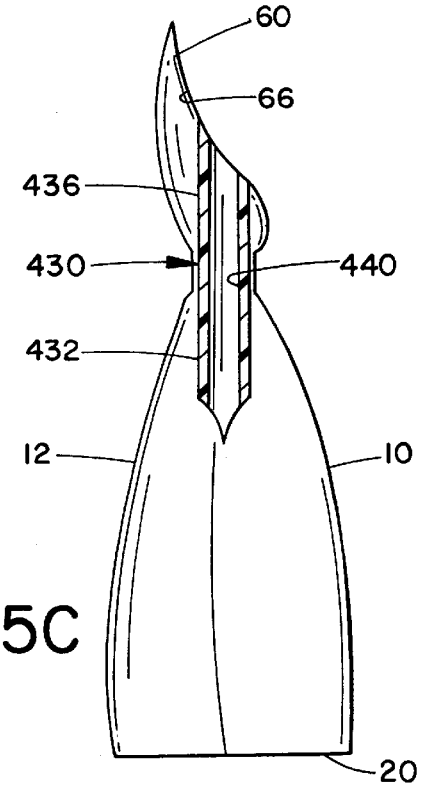
FIG. 5C is a simplified cross-sectional view taken along view lines 5C—5C of FIG. 5A.

FIGS. 5A–5C show a further alternative fluid dispensing apparatus in accordance with the present invention including a fitment 430. Except as noted and illustrated in the drawings, fitment 430 is similar in all respects to fitment 30, and corresponding parts relative to fitment 30 are identified with corresponding reference numerals "400" greater than those used in FIGS. 1A–1C.

Fitment 430 is connected to a pouch A in a peripheral seam 16 as described above in relation to the fitment 30. Fitment 430 comprises an elongated member of cylindrical, semi-cylindrical, or other suitable external shape having an axial bore 440 therethrough. The bore 440, at the lower or base portion 432 of the fitment 430, is in fluid communication with the pouch interior. A sanitary overwrap 60 is connected to or forms a part of the pouch A.

With particular reference to FIG. 5C, a portion of an inner surface 66 of the overwrap 60 is sealingly engaged with the outermost region of the fitment neck 436 by adhesive, heat fusion, or other convenient means so that the upper or opposite end of the through-bore 440 is closed in a fluid-tight manner by the overwrap 60. Upon removal of the overwrap 60 to expose the fitment neck 436 for dispensing fluid from the pouch A, the inner surface 66 of the overwrap 60 is pulled away from the fitment neck 436 to open the through-bore 440, thus allowing fluid to be dispensed from the pouch A through the bore 440.

Figure 6A:
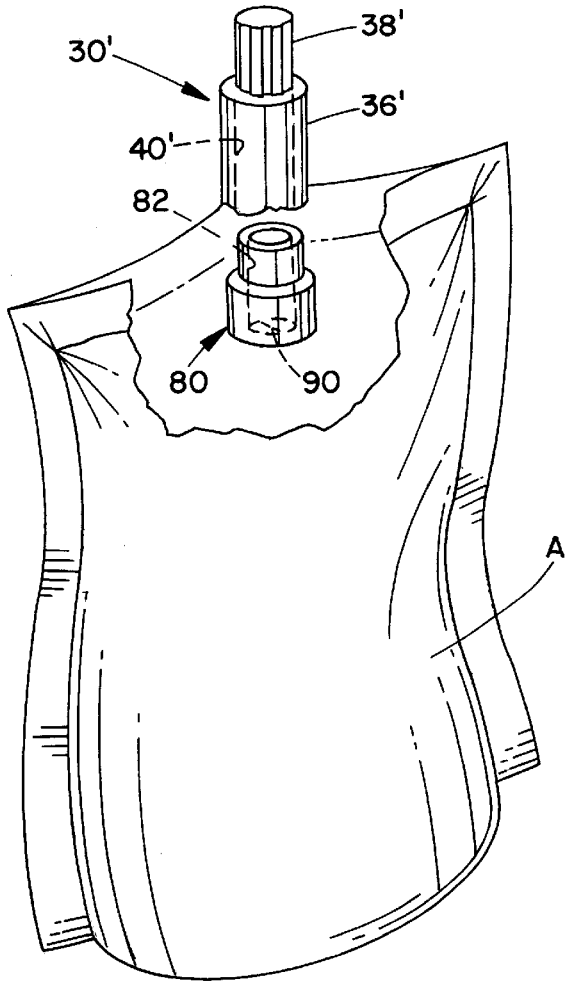
FIG. 6A is a perspective view, partially broken away, of a fluid dispensing apparatus with a fitment spout formed in accordance with the present invention, and including a fitment valve for preventing accidental spillage of liquid.

FIG. 6A illustrates a fluid dispensing apparatus with a fitment spout similar to that illustrated in FIG. 1A. There, pouch A is adapted for retaining liquid, and a fitment spout 30' is connected to the pouch for dispensing liquid therefrom. Fitment 30' is similar in all respects to the fitment 30, but further includes a normally closed valve assembly 80 adapted to prevent undesired or unintentional spillage of the liquid contents of pouch A. For clarity and ease of understanding the invention, the valve assembly 80 is shown herein in association with the fitment 30, but those of ordinary skill in the art will recognize that the valve assembly is also suitable for use in association with fitments 130,230,330,430 without in any way departing from the overall scope and intent of the invention.

Valve assembly 80 is fabricated from rubber, suitable resilient polymer, or any other appropriate material. Valve assembly 80 is connected to or fabricated as a one-piece construction with the remainder of the fitment 30' and is located within the pouch interior. A bore 82 is formed through the valve assembly and is disposed in fluid communication with the bore 40' in the first neck portion 36' of the fitment. The bore 82 is placed in selective fluid communication with the interior of the pouch A through a valve element 90.

Figure 6B:
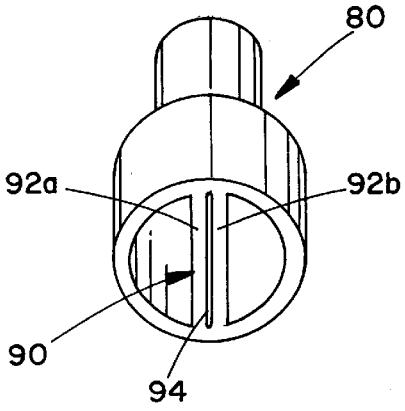
FIG. 6B is a perspective view of a fitment valve formed in accordance with the present invention in its normally closed condition.
Figure 6C:
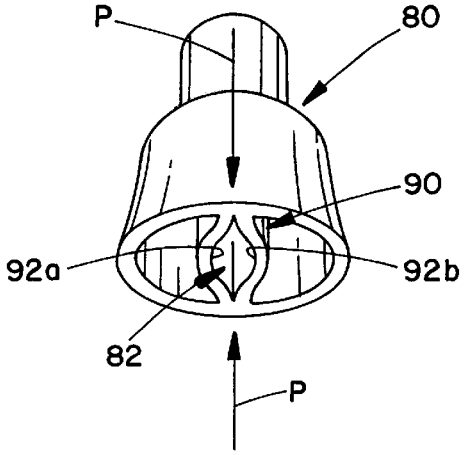
FIG. 6C is a perspective view of the valve of FIG. 6B shown in its open condition; and, FIG. 7 is a perspective view illustrating another alternative fluid dispensing apparatus with a fitment spout and valve formed in accordance with the present invention.

With reference also to FIGS. 6B and 6C, the valve element 90 selectively blocks fluid flow from the pouch A into the bore 82 and the bore 40'. As shown therein, valve element 90 comprises first and second sidewalls 92*a*,92*b* which lie in close spaced relation to each other for defining a normally closed passage or slit 94 therebetween (FIG. 6B). However, application of inwardly directed manual pressure to the valve assembly 80 in regions of the opposed ends of the slit 94, as indicated by the arrows P, causes the sidewalls 92*a*,92*b* to separate (FIG. 6C), thus allowing fluid flow between the sidewalls and into the bore 82. Accordingly, one desiring to dispense fluid from the pouch A need only apply pressure with their fingers, lips, teeth, or otherwise as indicated by the arrows P so that fluid flows freely from the pouch A into the bore 82, and outwardly from the bore 40'. Upon release of the manual opening pressure on the valve assembly 80, the sidewalls naturally return to their normal, close spaced relationship to close the passage 94 and block further fluid flow.

Of course, the valve element 90 may take many other suitable forms in order to provide a normally closed valve assembly that is selectively openable by a user upon application of pressure. Also, as with the fitment 30, the fitment 30' may be covered by a sanitary overwrap (not shown) to prevent its contamination during shipping, handling, and storage.

Figure 7:
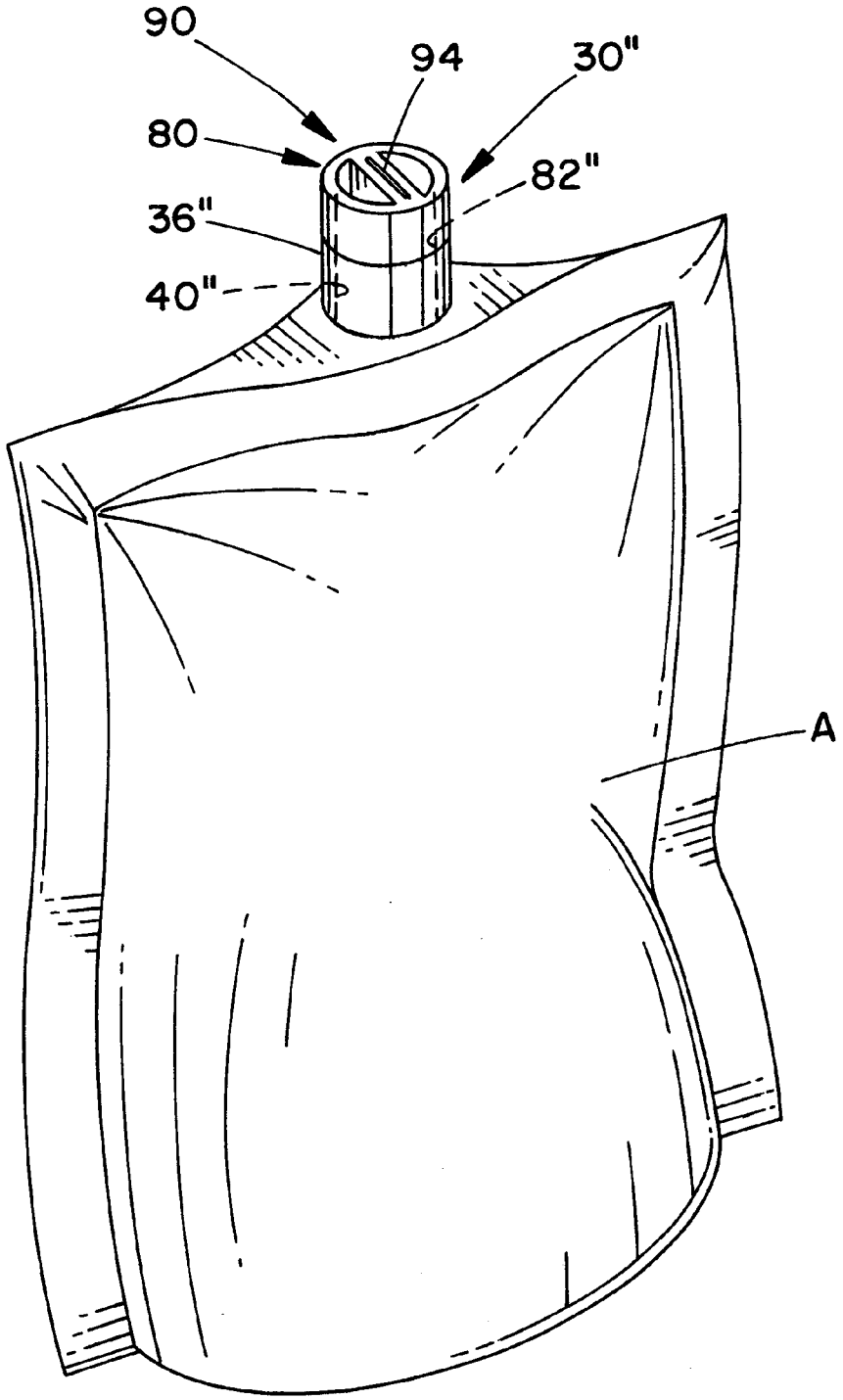

FIG. 7 illustrates yet another alternative fluid dispensing apparatus with fitment spout 30" including an exteriorly located valve assembly 80". The fitment spout 30" is similar to the fitment spout 30 discussed in relation to FIG. 1A, but includes a valve assembly 80" connected to or formed as a one-piece construction with the first neck portion 36" for preventing accidental or undesired spillage of liquid from the pouch A. The valve assembly is located external to the pouch for ease of operation. Otherwise, the valve assembly 80" is similar in all respects to the valve assembly 80, and is likewise selectively opened by application of pressure to the regions located at the opposite ends of the slit 94 so that a liquid flow path is created from the pouch A, into the bore 40", into the bore 82", and out of the valve assembly for consumption.

The invention has been described with reference to preferred embodiments. Obviously, modifications and alterations will occur to others upon reading and understanding the preceding specification. It is intended that the invention be construed as including all such modifications and alterations insofar as they are within the scope of the appended claims and equivalents thereto.

Having thus described the preferred embodiments, the invention is now claimed to be:

1. A fluid dispensing system comprising:

a fluid container defining an internal cavity adapted for retaining fluid;

a fitment connected to said container and adapted for dispensing fluid from said container, said fitment comprising:

(i) a base adapted for securement to said container;

(ii) a neck first portion extending outwardly from said base away from said container, said neck first portion and base including a bore therein in fluid communication with said internal cavity of said container; and, (iii) a neck second portion removably connected to said neck first portion in fluid-blocking relation with said bore by a weakened material zone, said neck second portion adapted for at least partial separation from said neck first portion upon application of stress to said neck second portion to thereby rupture said weakened material zone and open said bore; and, a removable flexible sanitary overwrap sheet material at least partially covering the neck first portion.

2. The fluid dispensing system as set forth in claim 1 wherein said fitment comprises a one-piece construction of molded plastic, said weakened material zone interconnecting said neck first and second portions defined by a fluid-tight frangible region of said one-piece molded plastic construction having reduced thickness relative to adjacent regions of said fitment.

3. The fluid dispensing system as set forth in claim 1 wherein said first and second portions of said neck are cylindrical and wherein said second neck portion comprises ribs defined in an outer surface to facilitate manual application of torsional stress to said neck second portion.

4. The fluid dispensing system as set forth in claim 2 wherein said second portion of said neck is positioned within said bore and connected by said weakened material zone to a surrounding portion of said neck first portion.

5. The fluid dispensing system as set forth in claim 4 wherein said neck second portion comprises a post projecting outwardly therefrom away from said bore, said post adapted for application of manual stress for facilitating at least partial separation of said neck second portion from said neck first portion along said weakened material zone.

6. The fluid dispensing system as set forth in claim 2 further comprising a pull-ring connected to and projecting upwardly from said neck second portion, said pull-ring adapted for manual grasping to facilitate application of stress to said neck second portion to effect at least partial separation of said neck second portion from said first portion at said weakened material zone.

7. The fluid dispensing system as set forth in claim 1, wherein said sanitary overwrap and said fluid container are defined from the same type of flexible sheet material.

8. The fluid dispensing system as set forth in claim 1 wherein said container comprises a flexible pouch defined by first and second opposite lateral side walls interconnected along a plurality of peripheral seams so as to define said internal cavity therebetween, said fitment connected to said pouch by placement of said base between said first and second sidewalls in one of said peripheral seams so that said fitment bore is in fluid communication with said internal cavity.

9. The fluid dispensing system as set forth in claim 1 wherein said container comprises a flexible pouch defined by first and second opposite lateral side walls interconnected along a plurality of peripheral seams so as to define said internal cavity therebetween, and wherein said base portion of said fitment is defined by a flange projecting radially outwardly from said neck first portion, said fitment base connected to said pouch by securement of said flange to one of said first and second pouch side walls so that said fitment bore is in fluid communication with said internal cavity.

10. A fluid dispensing system comprising:

a fluid container defining an internal cavity adapted for retaining fluid;

a fitment connected to said container and adapted for dispensing fluid from said container, said fitment comprising:

(i) a base adapted for securement to said container;

(ii) a neck first portion extending outwardly from said base away from said container, said neck first portion and base including a bore therein in fluid communication with said internal cavity of said container; and, (iii) a neck second portion removably connected to said neck first portion in fluid-blocking relation with said bore by a weakened material zone, said neck second portion adapted for at least partial separation from said neck first portion upon application of stress to said neck second portion to thereby rupture said weakened material zone and open said bore; and, a normally closed valve connected to said fitment and located in said internal cavity of said fluid container, said valve, when closed, substantially blocking fluid flow out of said container internal cavity through said bore, said valve selectively openable to allow fluid flow out of said container internal cavity through said bore when said neck second portion is at least partially separated from said first neck portion.

11. The fluid dispensing system as set forth in claim 10 wherein said valve comprises:

first and second sidewalls movable relative to each other between a closed position wherein said sidewalls are placed closely adjacent to restrict fluid flow therebetween, and an open position wherein said sidewalls are spaced-apart sufficiently to allow fluid flow therebetween.

12. The fluid dispensing system as set forth in claim 11 wherein said valve is connected to said fitment base and positioned in said internal cavity of said container, said valve openable upon application of manual pressure thereto to deform said valve and move said sidewalls apart into said open position.

13. A fitment spout adapted for dispensing fluid from an associated container, said fitment spout comprising:

a base adapted for being fixedly secured to an associated container;

a neck first portion projecting outwardly from said base and associated container, said neck and base together defining a bore adapted for fluid communication with an interior fluid-containing portion of an associated container;

a neck second portion connected to said first portion and blocking said bore in a fluid-tight manner, said neck second portion interconnected to said neck first portion by way of a frangible zone of material whereby said neck second portion is adapted for selective separation from said neck first portion upon application of stress to said neck second portion to at least partially rupture said frangible material zone; and, a valve connected to said fitment base and adapted for placement inside of an internal cavity of said associated container, said valve adapted for substantially blocking fluid flow out of said internal cavity through said bore and selectively openable to allow fluid flow through said bore.

14. The fitment spout as set forth in claim 13 wherein said fitment comprises a one-piece construction of molded plastic, said weakened material zone interconnecting said neck first and second portions defined by a frangible region of said one-piece molded plastic construction having reduced material thickness relative to surrounding portions of said fitment spout.

15. The fitment spout as set forth in claim 14 wherein said second portion of said neck is positioned in said bore and connected by said weakened material zone to a surrounding portion of said neck first portion.

16. The fitment spout as set forth in claim 15 wherein said neck second portion comprises a post projecting outwardly therefrom away from said bore, said post adapted for application of manual stress for facilitating at least partial separation of said neck second portion from said neck first portion.

17. The fitment spout as set forth in claim 14 further comprising a pull-ring connected to and projecting upwardly from said neck second portion, said pull-ring adapted for manual grasping to facilitate application of stress to said neck second portion to effect at least partial separation of said neck second portion from said neck first portion at said weakened material zone.

18. The fitment spout as set forth in claim 13 further comprising a sanitary overwrap at least partially enclosing at least said neck first portion.

19. The fitment spout as set forth in claim 13 wherein said valve comprises:

first and second sidewalls movable relative to each other between a closed position wherein said sidewalls are placed closely adjacent to restrict fluid flow therebetween, and an open position wherein said sidewalls are spaced-apart sufficiently to allow fluid flow therebetween.

20. The fitment spout as set forth in claim 19 wherein said valve is openable upon application of manual pressure thereto so as to deform said valve and force said sidewalls apart into said open position.

21. A fluid dispenser comprising:

a container adapted to retain fluid in an interior portion thereof;

an elongated fitment member including a bore formed therethrough from a first end to a second end, said elongated fitment member connected to said fluid container so that said bore is in fluid communication with said interior portion of said container at said first end of said fitment member and so that said elongated fitment member projects outwardly from said container; and a selectively removable flexible sanitary overwrap at least partially covering said second end of said elongated fitment member, said sanitary overwrap including an inner surface sealingly and releasably engaged with said second end of said fitment member to block fluid flow out of said container interior portion through said bore.

22. A fluid container comprising:

a flexible pouch defining an interior space adapted to retain an associated fluid;

a fitment adapted for dispensing associated fluid from the interior space of the pouch, said fitment comprising: (i) a first portion secured to the pouch; (ii) a second portion located external to and projecting outwardly away from said pouch, said first and second portions defining a bore in fluid communication with the interior space of the pouch; and (iii) a valve located in said interior space of said pouch and at least substantially blocking fluid flow out of said interior space through said bore, said valve selectively manually openable by application of force through said pouch to allow fluid flow out of said interior space.

* * * * *